US011420848B2

(12) United States Patent
Studer et al.

(10) Patent No.: US 11,420,848 B2
(45) Date of Patent: Aug. 23, 2022

(54) ELEVATOR SAFETY SUPERVISING ENTITY WITH TWO UNITS HAVING AN OPTION FOR E.G. AUTONOMOUS PASSENGER EVACUATION

(71) Applicant: Inventio AG, Hergiswil (CH)

(72) Inventors: Christian Studer, Kriens (CH); Astrid Sonnenmoser, Hochdorf (CH); Ivo Lustenberger, Buttisholz (CH)

(73) Assignee: INVENTIO AG, Hergiswil Nw (CH)

( * ) Notice: Subject to any disclaimer, the term of this patent is extended or adjusted under 35 U.S.C. 154(b) by 817 days.

(21) Appl. No.: 16/333,277

(22) PCT Filed: Sep. 14, 2017

(86) PCT No.: PCT/EP2017/073096
§ 371 (c)(1),
(2) Date: Mar. 14, 2019

(87) PCT Pub. No.: WO2018/059945
PCT Pub. Date: Apr. 5, 2018

(65) Prior Publication Data

US 2019/0210838 A1 Jul. 11, 2019

(30) Foreign Application Priority Data

Sep. 29, 2016 (EP) ..... 16191256

(51) Int. Cl.
*B66B 5/02* (2006.01)
*B66B 5/00* (2006.01)
(Continued)

(52) U.S. Cl.
CPC ..... *B66B 5/027* (2013.01); *B66B 1/3446* (2013.01); *B66B 5/0031* (2013.01); *B66B 13/22* (2013.01)

(58) Field of Classification Search
CPC ..... B66B 5/0031; B66B 5/02; B66B 5/0018; B66B 5/00; B66B 1/3492; B66B 1/30;
(Continued)

(56) References Cited

FOREIGN PATENT DOCUMENTS

CA 3035405 A1 * 4/2018 ..... B66B 1/3446
CN 1367133 A 9/2002
(Continued)

*Primary Examiner* — Marlon T Fletcher
(74) *Attorney, Agent, or Firm* — William J. Clemens; Shumaker, Loop & Kendrick, LLP

(57) ABSTRACT

An elevator safety supervising entity (SSE) includes a car safety supervising unit (SSU) controlling functions of car safety components and having at least one car sensor sensing car-related parameters, a head SSU controlling functions of shaft safety components and having at least one shaft sensor sensing shaft-related parameters, and a data linkage transmitting signal data between the SSUs. Both SSUs detect a failure in the other one of the SSUs and in the data linkage signal data transmission and in response switch from a normal operation mode to a failure operation mode. In the failure operation mode, the SSUs operate autonomously to keep the elevator operative at least temporarily with a sufficiently high safety even when functions of the elevator SSE are disturbed due to failures and e.g. passengers may be evacuated from the elevator car before completely stopping elevator operation.

17 Claims, 1 Drawing Sheet

(51) Int. Cl.
*B66B 13/22* (2006.01)
*B66B 1/34* (2006.01)

(58) Field of Classification Search
CPC ..... B66B 1/32; B66B 5/027; B66B 5/0006; B66B 5/06; B66B 1/3446; B66B 7/1223; B66B 13/24; B66B 3/00
See application file for complete search history.

(56) References Cited

FOREIGN PATENT DOCUMENTS

| | | | | | |
|---|---|---|---|---|---|
| CN | 103407852 | A | | 11/2013 | |
| CN | 104692210 | A | | 6/2015 | |
| DE | 1032033 | A1 | | 4/1992 | |
| EP | 1852382 | A1 | | 7/2007 | |
| EP | 2022742 | A1 | | 2/2009 | |
| EP | 2022742 | B1 | | 6/2014 | |
| JP | 2005200143 | A | | 7/2005 | |
| JP | 2016088678 | A | | 5/2016 | |
| WO | WO-2006106174 | A1 | * | 10/2006 | ..... B66B 13/22 |
| WO | 2016062686 | A1 | | 4/2016 | |
| WO | 2016091779 | A1 | | 6/2016 | |
| WO | WO-2016091779 | A1 | * | 6/2016 | ..... B66B 1/34 |
| WO | WO-2018059944 | A1 | * | 4/2018 | ..... B66B 1/24 |
| WO | WO-2018059945 | A1 | * | 4/2018 | ..... B66B 1/3446 |

* cited by examiner

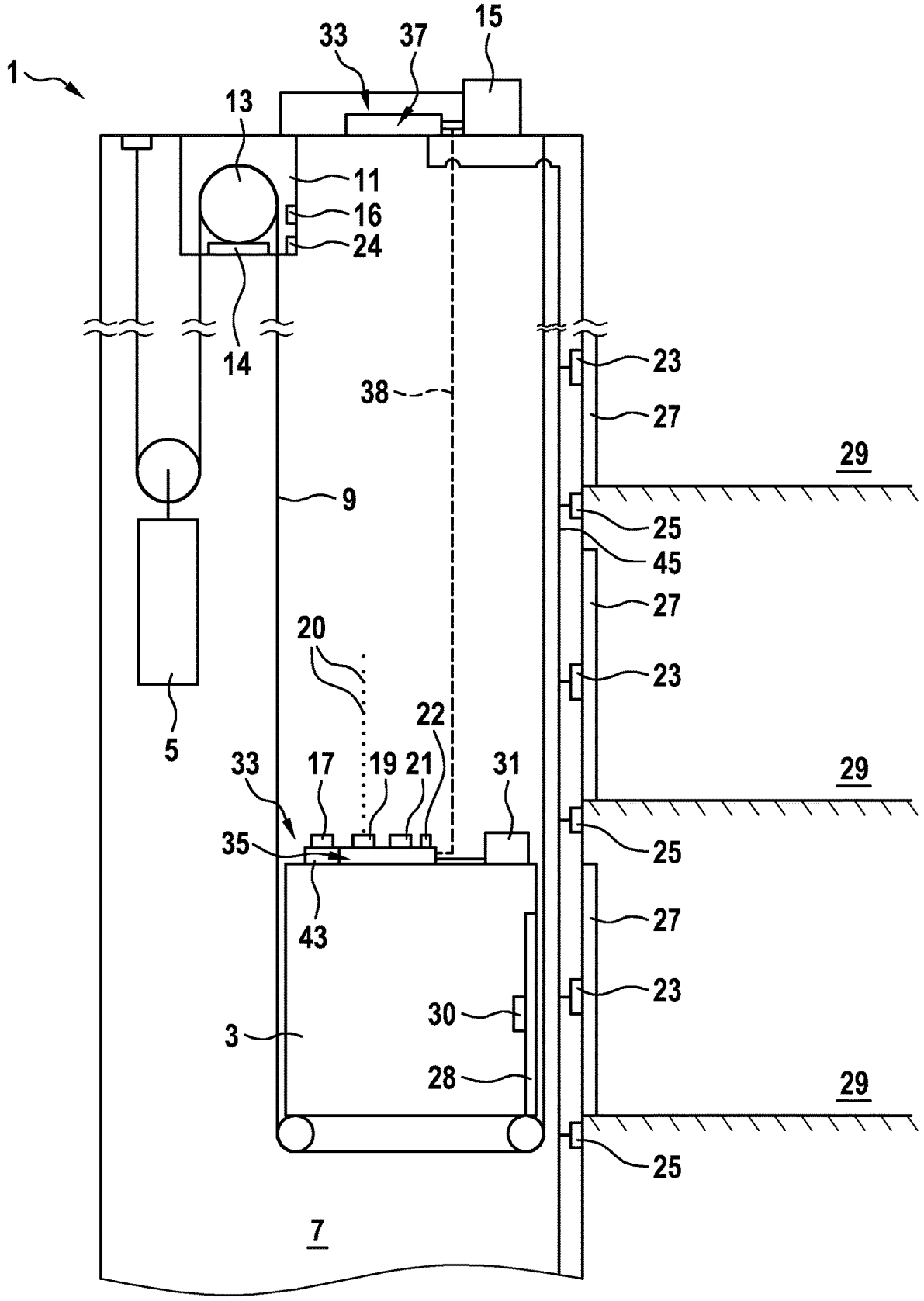
1
33
37
15
13
11
16
24
14
38
23
27
29
9
25
45
27
20
23
22
5
33
17
19
21
31
29
35
25
43
27
23
30
3
28
29
25
7

ELEVATOR SAFETY SUPERVISING ENTITY WITH TWO UNITS HAVING AN OPTION FOR E.G. AUTONOMOUS PASSENGER EVACUATION

FIELD

The present invention relates to an elevator safety supervising entity (SSE) including two separate safety supervising units (SSU) for supervising safety relevant conditions and controlling safety relevant functions in an elevator.

BACKGROUND

Elevators serve for transporting passengers or items between different levels within a building. For such purpose, an elevator car (sometimes referred to as a cabin) is displaced throughout an elevator shaft (sometimes referred to as a hoistway). The elevator car is driven by a drive engine motions of which are controlled by an elevator control.

As the elevator car is displaced over significant heights, severe safety and security requirements have to be fulfilled. Therefore, safety relevant conditions within the elevator are generally supervised or monitored by specific devices which, in case of detecting a safety critical condition, may instruct the elevator control or may overrule normal operation of the elevator control such as to bring the elevator in a safe state. Typically, such safe state is established by actuating a motor brake of the drive engine, bringing the drive engine into a safe torque off mode, activating a safety gear of the car (sometimes referred to as emergency brake) and/or closing a door lock at the car door. In the safe torque off mode the drive engine doesn't apply any torques or forces to the traction sheave. Thereby, normal operation of the elevator is immediately interrupted in order to thereby minimize dangers to elevator passengers in potentially hazardous conditions.

In conventional elevators, classic safety circuits including safety contacts connected in series which switch on/off the drive and/or brake power are generally included. Upon opening of one of the safety contacts, the entire safety circuit is interrupted and safety retaining actions may be initiated.

Such classic systems are currently intended to be replaced by electronic safety systems relying on a bus technology.

For example, EP 2 022 742 A1 discloses an example of such a bus-based electronic security system. The security system is organized in a decentral manner and includes two separate safety supervising units (SSUs). One SSU is comprised in or at the elevator car such as to be displaced together with the car and shall be referred to herein as car SSU. The other SSU is arranged stationary for example within the elevator shaft and will be referred to herein as head SSU. The two SSUs are interconnected via a secure bus system. For example, the car SSU monitors all safety relevant motion states of the car relating for example to the car's position, velocity and/or acceleration. The head SSU monitors for example safety contacts such as shaft door contacts or shaft end contacts.

WO 2016/062686 A1 discloses another example of an elevator comprising a decentralized electronic safety system with two separate SSUs.

Decentralized electronic safety systems comprising several distributed SSUs may provide for various benefits. For example, wiring efforts for electrically interconnecting a multiplicity of safety relevant devices such as safety switches may be significantly reduced in a bus-based system. Generally, all safety-relevant devices may be connected to a same data linkage such as a bus-based electrical connection system. Therein, the data linkage may be hardwired or wireless. Furthermore, each safety-relevant device may easily communicate its identification electronically using for example a series of bit data thereby informing e.g. the SSU receiving its signals about its identity, function and/or location. Accordingly, various additional functionalities may be implemented in a bus-based system, such functionalities being hardly applicable in conventional classic systems.

In a safety supervising entity comprising separate SSUs connected via a data linkage, each component is designed for maximum safety of an elevator operation. For such purpose, each SSU as well as the data linkage are generally configured to fulfil a high safety integrity level (SIL). For example, the data linkage may be implemented with a safe fast link. Conventionally, in such safety supervising entity, each of the SSUs is adapted for detecting any internal failures or failures in data communication with the other SSU and to, upon detecting such failures, immediately stopping normal operation of the elevator and bringing the elevator into its safe state by typically actuating brakes, emergency gears, etc.

However, it has been found that conventional reactions to any failures within the components of the safety supervising entity may result in inconveniences or even hazards to the passengers in the elevator car. Particularly, evacuation of passengers from the elevator car may be troublesome.

Accordingly, there may be a need for an elevator safety supervising entity including separate SSUs, which may allow avoiding such inconveniences or even hazards to passengers in case of internal failures. Furthermore, there may be a need for an elevator comprising such elevator SSE.

SUMMARY

According to an aspect of the present invention, an elevator safety supervising entity for an elevator comprising an elevator car displaceable within an elevator shaft and further comprising elevator safety components including car safety components provided on the elevator car and shaft safety components provided stationary in the elevator shaft is proposed. The elevator safety supervising entity comprises a car safety supervising unit (car SSU), a head supervising unit (head SSU) and a data linkage. The car SSU is adapted for controlling functions of the car safety components and comprises at least one car sensor for sensing car-related parameters. The head SSU is adapted for controlling functions of shaft safety components and comprises at least one shaft sensor for sensing shaft-related parameters. The data linkage is adapted for transmitting signal data between the car SSU and the head SSU. Both the car SSU and the head SSU are adapted to operate in each one of a normal operation mode and a failure operation mode. Therein, both the car SSU and the head SSU are adapted to detect a failure in the other one of the car SSU and the head SSU and to detect a failure in signal data transmission via the data linkage and to switch from the normal operation mode to the failure operation mode upon detecting such failure. Furthermore, in the normal operation mode, the car SSU and the head SSU are adapted for exchanging signal data and the car SSU is adapted for generating control signals for controlling functions of the elevator safety components based on information derived from both the sensed car-related parameters and the sensed shaft-related parameters and the head SSU is adapted for controlling functions of the elevator safety components based on information derived from both the sensed car-related parameters and the sensed shaft-related parameters. In the failure operation mode, the car SSU and the head SSU are adapted for operating autonomously and the car SSU is adapted for controlling at least the functions of the car safety components based on information derived from the sensed car-related parameters but excluding the shaft-related parameters sensed by the at least one shaft sensor of the head SSU. Similarly, the head SSU is adapted for controlling at least the functions of the shaft safety components based on information derived from the sensed shaft related parameters but excluding the car-related parameters sensed by the at least one car sensor of the car SSU.

According to a second aspect of the invention, an elevator is proposed to comprise an elevator car displaceable within an elevator shaft and an elevator safety supervising entity according to an embodiment of the first aspect of the invention with its car SSU arranged at the elevator car and its head SSU arranged stationary relative to the elevator shaft.

Ideas underlying embodiments of the present invention may be interpreted as being based, inter alia, on the following observations and recognitions.

Upon operating an elevator, safety requirements have to be fulfilled in various conditions and circumstances during normal operation of the elevator, i.e. when the elevator car is displaced throughout the elevator shaft for transporting passengers. For such purpose, a decentralized elevator safety supervising entity with its separate car SSU and its head SSU typically comprises various sensors and various elevator safety components. Based on data or signals from the sensors, a safety critical state within the elevator may be detected and the elevator safety components may then be activated in order to bring the elevator into a safe state.

The sensors as well as the elevator safety components may be associated to either one of the car SSU and the head SSU.

For example, the car SSU may comprise one or more car sensors for sensing car-related parameters. Such cars sensors may be for example an acceleration sensor for sensing an acceleration of the elevator car, a velocity sensor for sensing a velocity of the elevator car and/or a position sensor for sensing a position of the elevator car, etc. These car sensors may be arranged in or at the car, preferably within a housing of the car SSU, such as to be moved together with the car. It's also possible that the sensors are located separate to the housing and exclusively electrically connected to the car SSU but still associated to the elevator car. Based on signals from such car sensors, the car SSU may control functions of specific elevator safety components referred to as car safety components. Such car safety components may be for example a safety gear of the car, i.e. a brake which may rapidly stop any car motion in case of an emergency by for example engaging with guide rails fixedly attached within the elevator shaft. Another example of a car safety component may be a car door lock which is generally closed as long as the elevator car is not stopped directly adjacent to a shaft door. Accordingly, upon sensing any excessive acceleration or velocity of the elevator car or any unintended position of the elevator car, the car SSU may control the car safety components for example to stop any motion of the car by activating the safety gear and/or keep the car door closed by activating the car door lock. Corresponding control signals may either be transmitted directly to the safety components or may be transmitted to the elevator control which then instructs the safety components.

The head SSU may comprise one or more shaft sensors for sensing shaft-related parameters. Such shaft sensors may be for example shaft door sensors for sensing whether or not a shaft door is correctly closed, door zone sensors for sensing whether the elevator car is currently in a door zone closely neighboring to a final stop position at a floor level, shaft end sensors for sensing whether the elevator car comes close to an end of the elevator shaft, etc. These shaft sensors may be arranged stationary within the elevator shaft or at a stationary position relative to the elevator shaft and exclusively electrically connected to the head SSU. Based on signals from such shaft sensors, the head SSU may control functions of specific elevator safety components referred to as shaft safety components. Such shaft safety components may be for example a motor brake of a drive engine driving for example a suspension traction means suspending the elevator car. By activating such motor brake, a motion of the elevator car may be stopped by stopping its suspension traction means. Furthermore, such shaft safety components may be for example a safe torque off switch, which may interrupt an energy supply to the motor of the elevator drive engine such that the motor may no more create any torque or force acting onto the suspension traction means. Accordingly, upon sensing that for example any shaft door is open while no elevator car is adjacent to this shaft door or is at least within its door zone, the head SSU may control the shaft safety components for example to stop any motion of the car by activating the motor brake and actuating the safe torque off switch.

The actions described in the preceding paragraph of sensing car-related and shaft-related parameters using the car sensors and shaft sensors, respectively, and then initiating safety enhancing actions by suitably controlling functions of the elevator safety components shall always be performed during normal operation of the elevator safety supervising entity. During such normal operation mode, the car SSU and the head SSU typically exchange signal data. Such signal data may be non-processed data from the respective cars sensors and shaft sensors or may be data which have already been processed within the respective SSU. Therein, during the normal operation mode, the car SSU typically generates the control signals for controlling functions of the elevator safety components based on several or all of available information, i.e. from both the sensed car-related parameters provided by its own cars sensors as well as the sensed shaft-related parameters provided by the shaft sensors and transmitted from the head SSU to the car SSU via the data linkage. Similarly, during the normal operation mode, the head SSU typically generates the control signals for controlling functions of the elevator safety components based on several or all of available information, i.e. from both the sensed shaft-related parameters provided by its own shaft sensors as well as the sensed car-related parameters provided by the car sensors and transmitted from the car SSU to the head SSU via the data linkage. In other words, during normal operation, the car SSU and the head SSU may cooperate with each other in order to provide optimum safety supervision based on signals from both the car sensors and the shaft sensors, and, in case of any safety critical situation being detected, to provide optimum control of functions of the elevator safety components.

However, as briefly indicated in the introductory portion, internal failures may occur within the elevator safety supervising entity, i.e. within its car SSU, head SSU and/or data linkage. Conventionally, all components of the safety supervising entity are adapted such that upon any internal failure, the entire elevator is set into its safe mode, i.e. for example the safety gear and/or the motor brake are activated such that the elevator car is immediately stopped.

However, while such immediate stopping of the elevator car may generally avoid death-trap dangers during elevator operation such as a freefall of the elevator car, it may at least cause inconveniences or even harmful dangers to car passengers.

For example, when the safety gear is actuated, the elevator car is generally stopped very abruptly such that excessive acceleration may endanger passengers such as elderly people or pregnant women. Furthermore, for example a safety gear is typically designed such that upon being actuated once it may only be released by trained maintenance personnel. Accordingly, passengers trapped within the car may have to wait for such personnel and may therefore not be quickly evacuated from the car.

It is therefore proposed to modify the car SSU and the head SSU in a way such that they may detect failures in the other one of the car SSU and the head SSU and, particularly, to detect failures in a signal data transmission via the data linkage between the car SSU and the head SSU. Upon detecting such failure in the other SSU or the data linkage, the respective SSU shall automatically switch from its preceding normal operation mode to a specific failure operation mode. However, in such failure operation mode, the SSU may not necessarily immediately activate safety components in order to immediately stop motions of the elevator car.

Instead, it is proposed to adapt the car SSU and the head SSU for a specific autonomous operation. During such autonomous operation, the respective SSU does not necessarily need data, signals or information from the other SSU. Instead, for example the car SSU is adapted for controlling at least the functions of the car safety components based on information derived from the sensed car-related parameters, i.e. from signals of its own car sensors, but excluding the shaft-related parameters sensed by the shaft sensors of the head SSU. In other words, during its failure operation mode, the car SSU does not need further information or signals provided via the data linkage but may provide for a sufficient safety supervision autonomously. Similarly, the head SSU may be adapted for controlling at least the functions of the shaft safety components based on information derived from the sensed shaft-related parameters, i.e. from signals from its own shaft sensors, but excluding the car-related parameters sensed by the car sensors of the car SSU. Thereby, during its failure operation mode, the head SSU does not necessarily require any further information or signals provided by the data linkage but may provide for a sufficient safety supervision autonomously.

Accordingly, with the elevator safety supervising entity proposed herein, each of the car SSU and the head SSU may provide for a sufficient basic functionality even in cases where the other SSU and/or the data linkage between the SSUs does not correctly operate, such basic functionality allowing for example avoiding inconveniences or even hazards to car passengers in case of any failures within the safety supervising entity.

Particularly, according to an embodiment, at least one of the car SSU and the head SSU is adapted to, in the failure operation mode, control the functions of the elevator safety components such as to enable evacuating passengers from the elevator car.

In other words, when one of the car SSU and the head SSU detects that a failure occurred in the other SSU or in the data linkage between them, this SSU may be adapted to autonomously, i.e. without cooperation or feedback with the other SSU, control functions of the elevator safety components such as to enable safe evacuating of passengers from the elevator car. For example, during such evacuation procedure, the intact car SSU or head SSU may allow motion of the elevator car such as to bring passengers at least to a next shaft door where they can exit the elevator car towards a floor of the building.

According to an embodiment, the car SSU is adapted for controlling an actuation of a car safety gear and the car SSU is furthermore adapted for, in the failure operation mode, keeping the safety gear in a non-actuated state for at least a predetermined period.

In other words, one of the car safety components controlled by the car SSU may be the safety gear which, upon its actuation, may quickly stop the car motion. However, while in each really dangerous situation such as in a freefall of the car due to for example breakage of the suspension traction means, this safety gear is to be actuated as fast as possible, the car SSU's reaction upon determining any failure in the head SSU or the data linkage may be different. In fact, such failures in components of the SSE do typically not directly result in dangerous situations, which would immediately require for example safety gear actuation. For example, an interruption in the data linkage may typically prevent normal operation of the SSE itself, but as long as no other defects occur in the elevator, such failures do normally not jeopardize an integrity or even safety of the elevator and its passengers. Accordingly, it appears to be acceptable to at least postpone an activation of the safety gear for a predetermined period of time. Such period may last for example between a few seconds and up to a few minutes, for example at most 5 minutes. It may be assumed that the statistic risk of any serious damages within the elevator occurring just in such short period of time after occurrence of the failure in the SSE may be negligible. In such period of time, passengers may be evacuated from the elevator car for example by bringing the car to the closest floor or even to a destination floor in the building. After such evacuation has been completed, the car SSU may then actuate the safety gear in order to bring the elevator into a safe state. Such finally attaining the safe state may be necessary as, upon any failure in the SSE, serious damages or failures within elevator components may no more be safely detected.

Similarly, according to an embodiment of the invention, the car SSU is adapted for controlling an actuation of a car door lock and the car SSU is adapted for, in the failure operation mode, keeping the car door lock in an unlocked state for at least a predetermined period.

In other words, one of the car safety components controlled by the car SSU may be the car door lock, which, upon its actuation, prevents the car door from being opened. Such car door lock is typically kept closed as long as it may not be certified that the elevator car is currently stopped at a position directly adjacent to a shaft door. For example, as long as the elevator car is moved throughout the elevator shaft or is stopped at a position between two vertically neighboring shaft doors, the car door lock keeps the car door closed in order to avoid any dangers to passengers. Furthermore, in conventional systems, when any failures occurred in an SSU, the car door lock was automatically closed or kept closed in order to be on the safe side as it could no more be certified that the elevator car is at an allowable position, for example within a door zone close to a shaft door.

However, in case of an internal failure within the SSE, it may be assumed to be allowable to enable opening the car door at least for a predetermined period of time such as for example a few seconds or for up to a few minutes, e.g. 5 min.

Accordingly, in such period, the elevator car may be brought to a next floor and the car door may be opened there such that the passengers may exit. After such evacuation is completed, the car SSU may control the car door lock to come into its locked state in order to guarantee for example that no further passengers enter the elevator car.

In another embodiment, the head SSU is adapted for at least one of controlling an actuation of a motor brake and activating of a safe torque off mode of an elevator drive engine and the head SSU is adapted for, in the failure operation mode, keeping the motor brake in a non-actuated state for at least a predetermined period.

Expressed differently, two of the shaft safety components controlled by the head SSU may be the motor brake and the safe torque off switch, which are normally actuated upon detecting any failure, malfunction or even emergency during elevator operation. However, as failures in the SSE do generally not indicate hazards requiring immediate counter-action, it may be sufficient to, upon detecting such failures, switch from the normal operation mode to the failure operation mode but, at least for a predetermined period of time, keep the motor brake in its non-actuated state. Generally, during such a period, the safe torque off mode is held de-activated in order to enable further motion of the elevator car. Again, during such limited period of time, passengers may be evacuated before, finally, the motor brake is actuated in order to avoid further motion of the elevator car without sufficient safety supervision.

According to another embodiment, the head SSU is again adapted for controlling an actuation of a motor brake and for activation of a safe torque off mode of an elevator drive engine, but in this case the head SSU is adapted for, in the failure operation mode, generally closing the motor brake but releasing the motor brake intermittingly for short periods of time.

Thus, in contrast to the preceding embodiment, in which the motor brake was completely kept open during the predetermined period of time, it may beneficially increase safety to not completely open the motor brake but to operate the motor brake in a so-called PEBO mode (pulsed electronic brake opening). In such PEBO mode, the motor brake is intermittently opened for a very short period of time of for example some milliseconds to at most some seconds before then being closed again. Accordingly, on the one hand, the elevator car may be moved throughout the elevator shaft towards a next shaft door exit during the phases where the motor brake is briefly opened but, on the other hand, the elevator car may be prevented from moving with excessive velocities.

According to an embodiment, in the failure operation mode, at least one of the car SSU and the head SSU is adapted for controlling functions of the safety components which functions, in the normal operation mode, are controlled by the other one of the car SSU and the head SSU.

In other words, while, during normal operation, safety supervision within the elevator is shared between the car SSU and the head SSU and each of these SSUs controls specific functions of associated safety components, such sharing of controlling safety functions may be modified upon detecting any failure in one of the SSUs and/or the data linkage.

Particularly, for example in case of a failure in the head SSU, functions normally controlled by the head SSU may be taken over at least in part by the car SSU, and vice versa. Therein, it may be acceptable at least for a limited period of time that the car SSU is not perfectly adapted for performing or controlling such additional control actions.

Specifically, according to an embodiment, in the failure operation mode, at least one of the car SSU and the head SSU is adapted for deriving additional information on at least one of car-related parameters and shaft-related parameters based on knowledge about elevator operation parameters prior to detection of the failure.

In other words, in its failure operation mode, the remaining one of the car SSU and the head SSU generally does not receive any data or signals from the other SSU due to a failure in this other SSU or in the data linkage such that some of the information available during normal operation may be missing. However, the remaining SSU may be adapted for obtaining additional information helping it to continuously perform at least basic supervision functions. Such additional information may be derived from knowledge about elevator operation parameters which prevailed just before the failure was detected.

For example, if a last information obtained by the car SSU from the head SSU indicated that all shaft doors are correctly closed and then a failure occurs in the head SSU or in the data linkage, the car SSU will detect such failure and may assume with a high probability that for example in the next few seconds or minutes all shaft doors remain correctly closed. Similarly, when for example a last information obtained by the head SSU from the car SSU indicated that the elevator car was moving with an acceptable velocity, it may be assumed that such acceptable velocity will be maintained at least for the next few seconds or minutes, i.e. it may be assumed that no overspeed condition is likely to occur directly pursuant to the detected failure in the SSE.

Assuming such future condition based on information of prior conditions and for example extrapolating such prior conditions may legitimate at least temporarily restricted further operation of the elevator such as displacing the elevator car to a next floor for evacuating passengers.

According to an embodiment, the car SSU comprises at least one auxiliary car sensor, wherein, in the failure operation mode, the car SSU is adapted for deriving additional information on shaft-related parameters based on signals acquired by the auxiliary car sensor.

The auxiliary car sensor may be a sensor which may not be necessary during normal operation or which may only provide information being redundant to information provided by e.g. a shaft sensor during normal operation. However, during the failure operation mode, information from such auxiliary car sensor may help the car SSU maintaining at least basic safety supervising functions.

For example, whether or not the elevator car is close to an end of the elevator shaft is typically determined using shaft end switches arranged within the elevator shaft. These shaft end switches are generally shaft sensors which provide their signals to the head SSU, and the signals may then be forwarded via the data linkage to the car SSU during normal operation. However, upon any failure in the head SSU or the data linkage, respective information will be missing in the car SSU. Additional sensors may be included in the car SSU for providing same or similar information. For example, a distance measurement device may be attached to the elevator car and may measure a current distance of the elevator car to a top or bottom of the elevator shaft. Such distance measurement device may use for example a laser beam directed to the top or bottom of the elevator shaft and may derive current distances from runtime measurements or interference measurements.

Similarly, according to another embodiment, the head SSU comprises at least one auxiliary shaft sensor, wherein, in the failure operation mode, the head SSU is adapted for deriving additional information on car-related parameters based on signals acquired by the auxiliary shaft sensor.

Such auxiliary shaft sensor may again not be necessary or may be redundant during normal operation but may provide helpful information upon any failure in the car SSU or the data linkage.

For example, during normal operation, a current velocity of the elevator car is generally sensed by a velocity sensor provided as a car sensor in the elevator car, and information about such velocity is then forwarded from the car SSU to the head SSU. However, upon any failure and therefore interruption of data transmission, respective velocity information will be missing at the head SSU. In order to obtain auxiliary information, for example an auxiliary shaft sensor sensing a current rotation velocity of the elevator drive engine or its traction sheave may be provided. Based on information from such auxiliary shaft sensor, the head SSU may at least approximately determine the current velocity of the elevator car and may adapt its control functions accordingly.

According to a specific implementation of the antecedent three embodiments, the additional information is derived with a lower safety integrity level than the sensed car-related parameters and the sensed shaft-related parameters.

In other words, it may be acceptable that the additional information derived for example from knowledge about prior elevator operation parameters or derived from signals of auxiliary car sensors or auxiliary shaft sensors may be less reliable than the information provided by the normal car sensors and shaft sensors, i.e. the information derived from the sensed car-related parameters or sensed shaft-related parameters.

Generally, car sensors and shaft sensors provided for the car SSU and head SSU, respectively, are adapted for providing their sensed parameters with a very high reliability, i.e. with a very high safety integrity level, in order to ensure that the SSE may supervise the safety of the elevator during normal operation in accordance with very high safety standards. Of course, deviations from such normal operation generally result in a loss of reliability. However, it is assumed herein that, in case suitable measures are taken, operation of the elevator may be continued at least temporarily for enabling e.g. evacuation of passengers. In order to further increase a safety level during such failure operation mode, deriving additional information as described above may be helpful. However, as such failure operation mode is non-standard and will generally be accepted only for a short period of time, it is assumed to be acceptable that such additional information may be less reliable, i.e. satisfy a lower safety integrity level, than information used for establishing safety supervising functions during normal operation.

According to an embodiment, the car SSU and/or the head SSU is adapted to remain in the failure operation mode only for a predetermined period of time and to then automatically switch into a safe stop operation mode by controlling elevator safety components to stop operation of the elevator.

In other words, while it may be acceptable to continue operating the elevator in its restricted failure operation mode for a short while after detecting any failure in one of the components of the SSE, after such predetermined period of time, the remaining intact car SSU or head SSU should automatically switch into the safe stop operation mode. In such safe stop operation mode, operation of the elevator is completely stopped and, particularly, any motion of the elevator car is stopped for example by actuating the safety gear and/or the motor brake. The period of time may be selected to be sufficiently long for driving the elevator car to a closest floor, opening the doors there and allowing the passengers to exit. Alternatively, the predetermined period of time may even be longer for bringing the passengers to their destination floors but then terminate operation of the elevator until for example maintenance personnel has repaired defective components of the SSE causing its failure. However, the predetermined period of time should not be excessively long in order to reduce a risk of any safety relevant defect occurring in the elevator during this period and not being safely detected by the SSE. For example, the predetermined period of time may be between 10 seconds and 10 minutes, preferably between 30 seconds and 3 minutes.

According to an embodiment, in the failure operation mode, the car SSU and the head SSU are adapted for controlling the functions of the car safety components and of the shaft safety components in accordance with enhanced safety rules.

This is based on the assumption that during normal operation, any potentially safety critical condition is detected by the SSE with high reliability and counteractions may be initiated within very short response times. However, during failure operation mode, reliability of detection of such safety critical condition may be reduced and counteractions may be initiated more slowly.

Accordingly, during failure operation mode, an overall safety of the elevator operation may be increased by controlling the functions of the car safety components and of the shaft safety components in accordance with enhanced safety rules. In other words, during such failure operation mode, the elevator safety components may be operated more cautiously.

As an example, while during normal operation specific velocities of the elevator car may be acceptable, limits for such car velocities may be set at a lower level during the failure operation mode. Accordingly, while the car may be displaced during normal operation for example with a maximum speed of 5 m/s, maximum speed may be limited to less than for example 2 m/s during failure operation such that for example response times upon detecting a safety critical condition may be increased.

Similarly, while during normal operation, the elevator car may be displaced into a close neighborhood of ends of the elevator shaft as its position may be reliably detected with the shaft end switches, during failure operation mode, a displacement range of the elevator car may be restricted.

It shall be noted that possible features and advantages of embodiments of the invention are described herein partly with respect to an elevator safety supervising entity and its components and partly with respect to an elevator comprising such elevator SSU. One skilled in the art will recognize that the features may be suitably transferred from one embodiment to another and features may be modified, adapted, combined and/or replaced, etc. in order to come to further embodiments of the invention.

In the following, advantageous embodiments of the invention will be described with reference to the enclosed drawing. However, neither the drawing nor the description shall be interpreted as limiting the invention.

DESCRIPTION OF THE DRAWINGS

FIG. 1 shows an elevator comprising an elevator safety supervising entity according to an embodiment of the present invention.

The FIGURE is only schematic and not to scale.

DETAILED DESCRIPTION

FIG. 1 shows an elevator 1 according to an embodiment of the present invention. The elevator 1 comprises an elevator car 3 and a counterweight 5 arranged in an elevator shaft 7. The elevator car 3 and the counterweight 5 are suspended by a suspension traction means 9 comprising several ropes or belts. The suspension traction means 9 is driven by a traction sheave 13 of a drive engine 11. An operation of the drive engine 11 is controlled by an elevator control 15. A motor of the drive engine 11 may be decelerated by a motor brake 14. Furthermore, a safe torque off switch 16 may interrupt energy supply to the drive engine 11 in order to prevent any torques or forces to be applied onto the suspension traction means 9 in certain situations. The elevator car 3 comprises a safety gear 31 which for example in case of an emergency such as a freefall may quickly stop the elevator car 3. Furthermore, a car door 28 is provided with a car door lock 30.

In order to be able to control functions of the elevator 1 and/or to guarantee its safety, the elevator 1 comprises a multiplicity of car sensors 17, 19, 21 and shaft sensors 23, 25.

For example, an acceleration sensor 17, a position sensor 19 and a car velocity sensor 21 are provided at the car 3 such that they are moved together with the car 3. The acceleration sensor 17 may determine the current acceleration of the car 3. For example, the acceleration sensor may be a microelectronics device which may output an acceleration signal being proportional to the current acceleration acting thereon. The position sensor 19 may determine a current position of the car 3 within the elevator shaft 7. For example, position marks 20 may be provided at predetermined positions within the elevator shaft 7 and by identifying these position marks, the position sensor 19 may determine its present position. The car velocity sensor 21 may determine a current velocity of the elevator car 3 upon displacement within the elevator shaft 7. Optionally, the car velocity sensor 21 and the position sensor 19 may cooperate or may be integrated into a single device.

The elevator 1 may further comprise shaft sensors 23, 25 which are positioned stationary within the elevator shaft 7. For example, shaft door contacts 23 may be provided at each of a multiplicity of shaft doors 27 arranged at each of floors 29 of a building. These shaft door contacts 23 may determine whether or not an associated shaft door 27 is correctly closed. Furthermore, door zone contacts 25 may be provided. These door zone contacts 25 may determine whether or not the elevator car 3 is currently in close neighborhood to one of the shaft doors 27. Such door zone contacts 25 may either be arranged stationary within the elevator shaft 3 such as to sense a presence of a neighboring elevator car 3 or may be arranged at the elevator car 3 such as to sense for example markers provided stationary adjacent to each door zone.

Signals of the multiplicity of sensors 17 to 25 may be processed within an elevator safety supervising entity (SSE) 33. In order to suitably process these signals and to suitably control elevator safety components such as the motor brake 14, the STO switch 16, the car door lock 30 and/or the safety gear 31, the elevator SSE 33 is composed of two separate SSUs, namely a car SSU 35 and a head SSU 37.

During normal operation of the elevator 1, both the car SSU 35 and the head SSU 37 may cooperate and may communicate with each other via a data linkage 38. Furthermore, the car SSU 35 and the head SSU 37 may communicate with the elevator control 15 and with other components of the elevator 1 such as the elevator's safety components 14, 16, 30, 31 in order to control various functionalities and safety functions of the elevator 1.

The car SSU 35 is attached to the elevator car 3 such as to be moved together with the elevator car 3. Using its acceleration sensor 17, position sensor 19 and velocity sensor 21, the car SSU 35 may detect car-related parameters such as the car's position, velocity and/or acceleration. Based for example on signals of the acceleration sensor 17 indicating a current acceleration of the elevator car 3, the car SSU 35 may then detect for example an occurrence of a freefall of the elevator car 3. Thereupon, the car SSU 35 may rapidly activate the car's safety gear 31.

The car SSU 35 furthermore comprises a proprietary energy source 43 such as a buffer battery or a capacitor of sufficiently large capacitance for supplying electrical energy. Thus, the car SSU 35 may at least temporarily operate independent of any electricity supply from e.g. a building's grid.

The head SSU 37 is connected to the plurality of shaft door sensors 23 and door zone sensors 25. Therein, each of the shaft door sensors 23 and the door zone sensors 25 may be connected to a bus 45 such as to enable signal transmittance to the head SSU 37 with a minimum of wiring efforts.

Using the car SSU 35 and the head SSU 37 in corporation, the elevator SSE 33 may monitor a multiplicity of conditions in the elevator 1 using the variety of different sensors 17 to 25 and may control functions of the elevator 1 based on signals provided by these sensors, possibly after suitable processing thereof.

Particularly, during normal operation of the elevator 1, the elevator SSE 33 may supervise all safety critical conditions such as an occurrence of a freefall of the elevator car 3, the elevator car 3 reaching an end zone of the elevator shaft 7, at least one of the shaft doors 27 being open without the car 3 being stopped adjacent to this shaft door 27 and/or other safety-related conditions. During such normal operation, each of the car SSU 35 and the head SSU 37 may receive signals from its associated sensors 17 to 25 and may process these signals and/or may transmit signals to the other one of the head SSU 37 and the car SSU 35. Based on a combination of several or even all of sensed car-related functions and shaft-related functions, the car SSU 35 and the head SSU 37, respectively, may control functions of the car safety components, such as the car door lock 30 and the safety gear 31, and functions of the shaft safety components, such as the motor brake 14 and the STO switch 16, in order to satisfy elevated safety requirements during elevator operation. In other words, the entire safety supervising efforts may be shared between the car SSU 35 and the head SSU 37 during normal operation.

However, additional to such normal operation mode, the car SSU 35 as proposed herein shall be specifically adapted to provide for at least some basic safety supervising functionalities in an autonomous manner in situations in which the head SSU 37 and/or the data linkage 38 shows some failures, i.e. in cases in which the car SSU 35 may no more be able to communicate with the head SSU 37. Same may be true, vice versa, for the head SSU 37 in case failures occur in the car SSU 35 and/or the data linkage 38.

For example, when a failure in the head SSU 37 or in the data linkage 38 is detected, the car SSU 35 may automatically switch into its failure operation mode, in which the velocity and/or the position of the car may be autonomously supervised by the car SSU 35. In such situation, the safety gear 31 is generally kept open, i.e. kept in a released mode in which is does not stop the elevator car 3. Specifically, limits of the velocity and/or the position of the car 3 may be adapted to the specific failure operation mode. Such operation mode may allow to continue moving the elevator car 3 without immediate activation of the safety gear 31. The safety gear 31 may be beneficially implemented in a manner such as to be effective in both of opposing directions of a car motion.

In another example, upon failure of the head SSU 37 or of the data linkage 38, the car SSU 35 may automatically switch into its failure operation mode in which it autonomously monitors the door zone. Therein, the car door lock 30 is kept in a mode in which it may be deactivated. Accordingly, the car door 28 in the door zone may be opened in case of an evacuation.

Upon a failure of the car SSU 35 or the data linkage 38, the head SSU 37 may switch into a failure operation mode in which controlled releasing of the motor brake 14 is allowed at least for a predetermined period of time, preferably in a pulsed electronic brake opening (PEBO) mode. The head SSU 37 supervises opening and closing of the motor brake 14 autonomously and thereby enables a controlled motion of the elevator car 3 in case of an evacuation of passengers.

Upon a failure in the car SSU 35 or the data linkage 38, the head SSU 37 may obtain an alternative velocity signal or position signal with which the head SSU 37 may keep open the motor brake 14 and the STO 16 at least for a predetermined period of time, in order to enable an evacuation run of the elevator car 3.

Generally, safety functions which are normally embedded in the head SSU 37 may be taken over by the car SSU 35 in case of a failure, and vice versa.

The car SSU 35 comprises an auxiliary car sensor 22 formed by a distance measurement device, which allows determining the current position of the elevator car 3 based on a measured distance to a top of the elevator shaft 7. Thereby, additional information about the car position may be obtained e.g. in cases where a data exchange with the head SSU 37 and its shaft end sensors 25 is interrupted.

The head SSU 37 comprises an auxiliary shaft sensor 24 enabling measuring a rotation velocity of the traction sheave 13 of the drive engine 11, thereby providing additional information about a current velocity of the elevator car 3 in case e.g. data transmission between the car SSU 35 and its velocity sensor 19, on the one side, and the head SSU 37, on the other side, is disturbed.

With the elevator SSE 33 described herein, the elevator 1 may be kept operative at least temporarily with a sufficiently high safety even when functions of the elevator SSE 33 are disturbed due to failures and e.g. passengers may be evacuated from the elevator car 3 before e.g. completely stopping elevator operation.

Finally, it should be noted that the term "comprising" does not exclude other elements or steps and the "a" or "an" does not exclude a plurality. Also elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator safety supervising entity for an elevator, the elevator including an elevator car displaceable within an elevator shaft and elevator safety components including car safety components provided on the elevator car and shaft safety components provided stationary in the elevator shaft, the elevator safety supervising entity comprising:

a car safety supervising unit controlling functions of the car safety components and including at least one car sensor for sensing car-related parameters;

a head safety supervising unit controlling functions of the shaft safety components and including at least one shaft sensor for sensing shaft-related parameters;

a data linkage transmitting signal data between the car safety supervising unit and the head safety supervising unit;

wherein both the car safety supervising unit and the head safety supervising unit are adapted to operate in each one of a normal operation mode and a failure operation mode;

wherein the car safety supervising unit and the head safety supervising unit are adapted to detect a failure in the head safety supervising unit and the car safety supervising unit respectively, to detect a failure in the signal data transmission via the data linkage, and to switch from the normal operation mode to the failure operation mode upon detecting the failure;

wherein, in the normal operation mode, the car safety supervising unit and the head safety supervising unit exchange the signal data, the car safety supervising unit generates control signals for controlling functions of the elevator safety components based on information derived from both the sensed car-related parameters and the sensed shaft-related parameters, and the head safety supervising unit generates control signals for controlling functions of the elevator safety components based on information derived from both the sensed car-related parameters and the sensed shaft-related parameters; and wherein, in the failure operation mode, the car safety supervising unit and the head safety supervising unit are adapted for operating autonomously, the car safety supervising unit is adapted for controlling at least the functions of the car safety components based on the information derived from the sensed car-related parameters but excluding the shaft-related parameters sensed by the at least one shaft sensor of the head safety supervising unit, and the head safety supervising unit is adapted for controlling at least the functions of the shaft safety components based on the information derived from the sensed shaft-related parameters but excluding the car-related parameters sensed by the at least one car sensor of the car safety supervising unit.

2. The elevator safety supervising entity according to claim 1 wherein at least one of the car safety supervising unit and the head safety supervising unit is adapted to, in the failure operation mode, control the functions of the elevator safety components to enable evacuating passengers from the elevator car.

3. The elevator safety supervising entity according to claim 1 wherein the car safety supervising unit is adapted for controlling an actuation of a car safety gear of the elevator car and wherein the car safety supervising unit is adapted for, in the failure operation mode, keeping the safety gear in a non-actuated state for at least a predetermined period.

4. The elevator safety supervising entity according to claim 1 wherein the car safety supervising unit is adapted for controlling an actuation of a car door lock of the elevator car and the car safety supervising unit is adapted for, in the failure operation mode, keeping the car door lock in an unlocked state for at least a predetermined period.

5. The elevator safety supervising entity according to claim 1 wherein the head safety supervising unit is adapted for at least one of controlling an actuation of a motor brake of the elevator and activating of a safe torque off mode of an elevator drive engine of the elevator, and the head safety supervising unit SSU is adapted for, in the failure operation mode, keeping the motor brake in a non-actuated state for at least a predetermined period.

6. The elevator safety supervising entity according to claim 1 wherein the head safety supervising unit is adapted for controlling an actuation of a motor brake of the elevator and for activation of a safe torque off mode of an elevator drive engine of the elevator, and the head safety supervising unit is adapted for, in the failure operation mode, closing the motor brake but releasing the motor brake intermittingly for short periods of time.

7. The elevator safety supervising entity according to claim 1 wherein, in the failure operation mode, at least one of the car safety supervising unit and the head safety supervising unit is adapted for controlling functions of the elevator safety components, which functions, in the normal operation mode, are controlled by the head safety supervising unit and car safety supervising unit respectively.

8. The elevator safety supervising entity according to claim 1 wherein, in the failure operation mode, at least one of the car safety supervising unit and the head safety supervising unit is adapted for deriving additional information on at least one of car-related parameters and shaft-related parameters based on knowledge about elevator operation parameters prior to detection of the failure.

9. The elevator safety supervising entity according to claim 8 wherein the additional information is derived with a lower safety integrity level than the sensed car-related parameters and the sensed shaft-related parameters.

10. The elevator safety supervising entity according to claim 1 wherein the car safety supervising unit includes at least one auxiliary car sensor, wherein, in the failure operation mode, the car safety supervising unit is adapted to derive additional information on shaft-related parameters based on signals acquired by the auxiliary car sensor.

11. The elevator safety supervising entity according to claim 10 wherein the additional information is derived with a lower safety integrity level than the sensed shaft-related parameters.

12. The elevator safety supervising entity according to claim 1 wherein the head safety supervising unit includes at least one auxiliary shaft sensor, wherein, in the failure operation mode, the head safety supervising unit is adapted to derive additional information on car-related parameters based on signals acquired by the auxiliary shaft sensor.

13. The elevator safety supervising entity according to claim 12 wherein the additional information is derived with a lower safety integrity level than the sensed car-related parameters.

14. The elevator safety supervising entity according to claim 1 wherein at least one of the car safety supervising unit and the head safety supervising unit is adapted to remain in the failure operation mode only for a predetermined period of time and to then automatically switch into a safe stop operation mode by controlling elevator safety components to stop operation of the elevator.

15. The elevator safety supervising entity according to claim 1 wherein, in the failure operation mode, the car safety supervising unit and the head safety supervising unit are adapted to control the functions of the car safety components and of the shaft safety components in accordance with enhanced safety rules.

16. The elevator safety supervising entity according to claim 1 wherein the at least one car sensor is an acceleration sensor for sensing an acceleration of the elevator car, a velocity sensor for sensing a velocity of the elevator car or a position sensor for sensing a position of the elevator car in the elevator shaft.

17. An elevator comprising;

an elevator car displaceable within an elevator shaft; and the elevator safety supervising entity according to claim 1 wherein the car safety supervising unit is attached to the elevator car and the head safety supervising unit is arranged stationary relative to the elevator shaft.

* * * * *